US011712136B2

(12) United States Patent
Hofman

(10) Patent No.: US 11,712,136 B2
(45) Date of Patent: Aug. 1, 2023

(54) SHOWERHEAD ASSEMBLY WITH INTEGRATED SOAP-SHAMPOO RESERVOIR

(71) Applicant: ETL, LLC, Sparks, NV (US)

(72) Inventor: David Hofman, Sparks, NV (US)

(73) Assignee: ETL, LLC, Sparks, NV (US)

( * ) Notice: Subject to any disclaimer, the term of this patent is extended or adjusted under 35 U.S.C. 154(b) by 253 days.

(21) Appl. No.: 17/150,266

(22) Filed: Jan. 15, 2021

(65) Prior Publication Data

US 2021/0353111 A1 Nov. 18, 2021

Related U.S. Application Data

(60) Provisional application No. 63/026,623, filed on May 18, 2020.

(51) Int. Cl.

| | |
|---|---|
| ***A47K 5/12*** | (2006.01) |
| ***B05B 1/18*** | (2006.01) |
| ***E03C 1/04*** | (2006.01) |

(52) U.S. Cl.

CPC ..... *A47K 5/1202* (2013.01); *B05B 1/185* (2013.01); *E03C 1/04* (2013.01)

(58) Field of Classification Search

CPC ..... E03C 1/04; E03C 1/046; E03C 1/0465; E03C 1/0409; A47K 5/1202; B05B 1/185

See application file for complete search history.

(56) References Cited

U.S. PATENT DOCUMENTS

| | | | | |
|---|---|---|---|---|
| 3,018,969 A * | 1/1962 | Gentry | B05B 7/1418 239/443 |
| 3,091,402 A * | 5/1963 | Palmer | E03C 1/046 239/303 |
| 3,367,580 A * | 2/1968 | Hronas | E03C 1/046 239/315 |
| 3,402,892 A | 9/1968 | Ayrial et al. | |
| 3,540,625 A * | 11/1970 | Lambe | A47L 15/4418 222/133 |
| 4,009,831 A * | 3/1977 | Arad | E03C 1/046 239/315 |
| 4,121,773 A | 10/1978 | Headen et al. | |

(Continued)

FOREIGN PATENT DOCUMENTS

| | | |
|---|---|---|
| GB | 2462819 | 2/2010 |
| KR | 101006125 | 12/2010 |

(Continued)

*Primary Examiner* — J C Jacyna

(74) *Attorney, Agent, or Firm* — David G. Duckworth; One LLP

(57) ABSTRACT

An improved showerhead assembly is provided for facilitating the application of soap or shampoo upon a bather. The showerhead assembly is preferably handheld and includes an elongate handle, and a showerhead including a face having one or more nozzles for spraying water. In addition, the showerhead assembly includes a detachable reservoir for storing soap or shampoo. Preferably, the reservoir is detachable from the showerhead by a threaded coupling in which the reservoir includes male threads which can be capped. Preferably, the showerhead assembly includes a controller for allowing one to selectively dispense shampoo or soap from within the reservoir into the stream of water which is ejected from the showerhead nozzles.

10 Claims, 8 Drawing Sheets

(56) References Cited

U.S. PATENT DOCUMENTS

| | | | | |
|---|---|---|---|---|
| 4,211,368 | A | 7/1980 | Legros et al. | |
| 4,467,964 | A * | 8/1984 | Kaeser | A46B 11/066 239/315 |
| 5,476,225 | A * | 12/1995 | Chan | B05B 3/04 239/383 |
| 7,661,607 | B1 | 2/2010 | Bowden | |
| 2009/0308951 | A1 * | 12/2009 | Suter | A01K 13/001 4/615 |
| 2012/0222695 | A1 | 9/2012 | Suter | |
| 2018/0229251 | A1 | 8/2018 | Duffus, III | |

FOREIGN PATENT DOCUMENTS

| | | |
|---|---|---|
| WO | 2009051501 | 4/2009 |
| WO | 2019221043 | 11/2019 |

* cited by examiner

SHOWERHEAD ASSEMBLY WITH INTEGRATED SOAP-SHAMPOO RESERVOIR

RELATED APPLICATIONS

The present application claims benefit of U.S. Provisional Patent Application Ser. No. 63/026,623 filed on May 18, 2020.

BACKGROUND OF THE INVENTION

The present invention relates to showerheads.

Showerheads are commercially available in numerous designs and configurations for use in showers, faucets, spas, sprinklers and other personal and industrial systems. The vast majority of showerheads include spray heads which may be categorized as being either stationary or oscillating and have either fixed or adjustable openings. Stationary spray heads with fixed jets are the simplest constructions consisting essentially of a central conduit connected to one or more spray nozzles directed to produce a constant pattern. The stationary spray showerheads cause water to flow through the construction to contact essentially the same points on a user's body in a repetitive fashion.

Multifunction showerheads are able to deliver water in many different spray patterns such as a fine spray, a coarse spray, a pulsating spray, or even a flood pattern providing high fluid flow but decreased velocity. Of course, many other spray patterns may also be provided.

A conventional multifunction showerhead generally requires the user to turn a selector ring or dial on the showerhead faceplate in order to select a desired function. Other common constructions include a faceplate with spray jets located in concentric circular patterns. An internal controller, such as controlled by buttons or the like, may be operated to direct the incoming water to any of the various patterns. Examples of such constructions are disclosed in U.S. Pat. Nos. 5,433,384 and 6,622,945.

A handheld showerhead assembly typically includes a hollow handle connected to a water supply by a flexible rubber hose. The handle has a proximal end which typically has a threaded inlet for connecting to a rubber hose. Meanwhile, at the handle's distal end, the showerhead assembly includes a showerhead including a plurality of nozzles for ejecting water. Typically, the handle and showerhead face are angled relative to one another so that water is ejected at approximately 90° relative to the handle's longitudinal axis.

Advantageously, the showerhead handle allows users to manipulate the spray nozzles into various positions and alignment to assist in the cleaning process. Unfortunately, though handheld showerheads provide many advantages compared to their fixed showerhead counterpart, handheld showerheads still suffer from several disadvantages. For example, many handheld shower assemblies do not allow a user to direct water to multiple locations at the same time.

More recently, shower stalls have been provided with a primary showerhead, and additional nozzles which project directly from the shower stall's walls which spray water in different directions than the primary showerhead. Unfortunately, these constructions require that expensive plumbing additions be made to the shower stall facility. Further, the wall nozzles cannot be moved to provide the variety that would be desirable for a shower user.

Bathers often use a variety of soaps, scrubs and shampoos when showering. Unfortunately, this can result in shower stalls being littered with a variety of dispensing bottles.

Furthermore, bathers must physically manipulate each bottle to dispense a liquid, such as shampoo.

Thus, it would be advantageous to provide a showerhead assembly that eliminated at least one fluid container from a bathroom shower stall. Furthermore, it would be advantageous to provide a showerhead assembly that facilitated the application of a fluid, such as shampoo or soap, upon a bather.

To this end, numerous attempts have been made to produce a showerhead which incorporated a soap and/or shampoo bottle. These include showerheads described in U.S. Pat. Nos. 3,402,892; 4,211,368; and 7,661,607 among others. These showerhead constructions typically entail integrating or attaching a reservoir, holding soap or shampoo, to the fixed or handheld showerhead. One or more conduits allow the liquid within the reservoir to drip or flow into the water stream before being expelled from the showerhead.

Unfortunately, these constructions are prone to clogging or do not allow the liquids within the reservoir to thoroughly mix with water before being expelled from the showerhead nozzles. This can result in the uneven distribution of the liquid soap or shampoo from the nozzles Furthermore, the lack of mixing can result in clogged conduits.

Therefore, it would be desirable to provide an improved showerhead with integrated reservoir for storing a liquid that provided improved mixing of the stored liquid with water prior to the mixture being expelled from the showerhead nozzles.

Moreover, it would be desirable to provide a showerhead assembly that did not require expensive modifications to the traditional shower stall architecture such as the introduction of additional plumbing within the walls of the shower stall.

SUMMARY OF THE INVENTION

Briefly, in accordance with the invention, an improved showerhead apparatus is provided which includes a hollow handle, a housing, a disengagable reservoir which stores soap or shampoo and is connected to the showerhead housing by a transition section, and a controller assembly so as to selectively allow fluid to pass through the assembly and expel out the nozzles.

Like typical handheld showerhead apparatus, the showerhead apparatus of the present invention includes an elongate hollow handle having a central channel. The handle has a proximal end which preferably is threaded for connecting to a traditional flexible hose which in turn is connectable to a water supply, such as a pipe projecting from a shower stall. Additionally, the central channel is in fluid connection with the showerhead's primary water conduit so as to release water from a primary outlet hole for expelling water to the showerhead. Like traditional handheld showerhead assembly, the handle extends longitudinally, defining an axis by which the showerhead face and resulting spray are angled so as to be more manageable within a shower. Preferably, the showerhead is positioned to be at an angle, such as 45° to 90° relative to the handle's longitudinal axis.

Additionally, the preferred showerhead can be relatively traditional in construction including a housing and a face having nozzles. Preferably, the showerhead includes a cavity which is formed between the face and a cavity wall. The cavity wall comprises an inlet diverter which is connected to the primary outlet hole so as to receive water from the hollow handle and allow such water to travel into the cavity. Specifically, the inlet diverter causes such water to be projected throughout the cavity in an orthogonal fashion instead of being expelled directly through the showerhead's nozzles. Furthermore, water pressure in the cavity allows for uniform water dispersal through the showerhead's nozzles.

The cavity wall further comprises an inlet hole in fluid connection with an inlet conduit, and an outlet hole in fluid connection with an outlet conduit. Additionally, the inlet conduit and outlet conduit are in fluid connection with a transition section which connects the showerhead to a reservoir. In the preferred embodiment, the reservoir includes male threads so as to be engagable and disengagable with the female threads formed on the exterior of the transition section. The detachable reservoir allows for the user to introduce shampoo or soap into a central chamber residing within the reservoir. Preferably, the detachable reservoir includes a cap so as to allow for separate storage of the reservoir from the showerhead.

In the preferred embodiment, the reservoir includes a housing which forms the central chamber for storing soap or shampoo and accepts water from the inlet conduit. Specifically, water is capable of passing from the cavity through the inlet hole and into the inlet cavity so as to enter the reservoir chamber and mix with fluid previously located therein, such as soap or shampoo. Subsequently, the mixture of fluid with water is capable of exiting the chamber through the outlet conduit so as to enter the cavity through the outlet hole.

Preferably, the showerhead assembly further comprises a controller assembly having an obstructer plate and switch, which allows the inlet diverter, inlet hole, and outlet hole to be selectively covered and uncovered so that water and fluid may accordingly pass through the showerhead assembly. Specifically, the plate is rotatably attached to the cavity wall by a pin which passes through a circular hole formed in the cavity wall. More specifically, the obstructer plate includes a plate inlet hole, plate outlet hole, and a tab. The pin allows the plate to rotate upon an axis so as to enable one to selectively align the plate inlet hole with the cavity wall inlet hole, thereby enabling the passage of water to the reservoir chamber. Further, in this rotation, the plate outlet hole is selectively aligned with the cavity wall outlet hole, thereby enabling the flow of fluid mixture to the cavity. Similarly, the plate's tab can be made to selectively align and block the flow of water from the inlet diverter. In the preferred embodiment, the tab only partially blocks the inlet diverter so as to enable the supply of water from the handle to at least trickle into the cavity and expel from the nozzles, thereby maintaining a constant water temperature.

Rotation of the controller assembly is accomplished by way of the switch. Preferably, the switch includes a slidable button and a lever arm. Preferably, the lever arm has a hole keyed to accept the plate's pin. Furthermore, the preferred embodiment of the controller assembly provides three settings. Upon the user manually sliding the button to the first setting position, the plate is selectively rotated so that the plate's inlet hole and outlet hole are not aligned with the cavity wall's inlet hole and outlet hole. Consequently, this unaligned configuration prevents water and fluid flow through the inlet conduit and outlet conduit, respectively. In the first setting position, the tab does not block the inlet diverter and water is capable of entering the cavity and thereby spraying through the showerhead nozzles.

Upon the user manually sliding the button to the second setting position, the plate is selectively rotated so as to properly align the plate's inlet hole and outlet hole with the cavity wall's inlet hole and outlet hole. In this second setting, the tab does not block the water flowing through the inlet diverter. As a result, water entering the cavity from the handle is capable of traveling through the inlet conduit and entering the reservoir chamber. This water mixes with the fluid located within the reservoir chamber so as to produce a mixture which then flows from the chamber through the outlet conduit. Consequently, the outlet conduit transports this mixture into the cavity, wherein the mixture is additionally mixed with water entering the cavity through the inlet diverter. Thereafter, the new mixture is expelled through the nozzles.

In accordance with the user sliding the button to the third setting position, the plate is selectively rotated so as to block the cavity wall's inlet hole and outlet hole. The inlet conduit and outlet conduit remain blocked in this rotated position so as to prevent any fluid within the reservoir from entering the cavity. Alternatively, the tab is positioned so as to only partially obstruct the inlet diverter, thereby allowing only a trickle of water to enter the cavity through the handle. Therefore, water trickling into the cavity is expelled through the nozzles.

Thus, it is an object of the present invention to provide a showerhead assembly having an improved construct so as to facilitate the application of a fluid, such as shampoo or soap, onto the user.

Furthermore, it is an additional object of the present invention to provide a showerhead assembly that provides a controller for allowing the user to selectively dispense fluid into the stream of water being ejected from the showerhead nozzles.

Other features and advantages of the present invention will be appreciated by those skilled in the art upon reading the detailed description which follows with reference to the drawings.

DETAILED DESCRIPTION OF THE INVENTION

Figure 1:
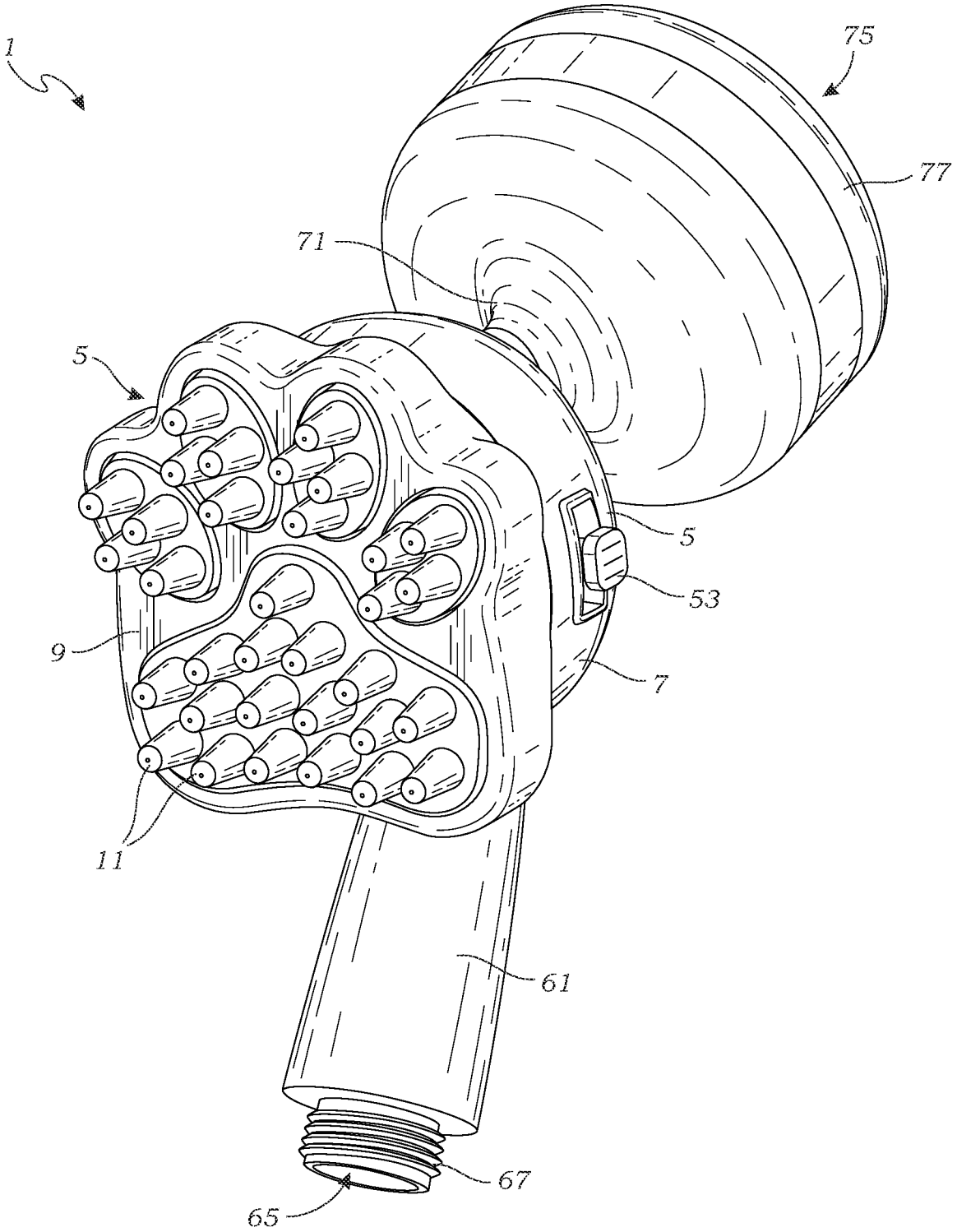
FIG. 1 is a front perspective view of a showerhead assembly.
Figure 2:
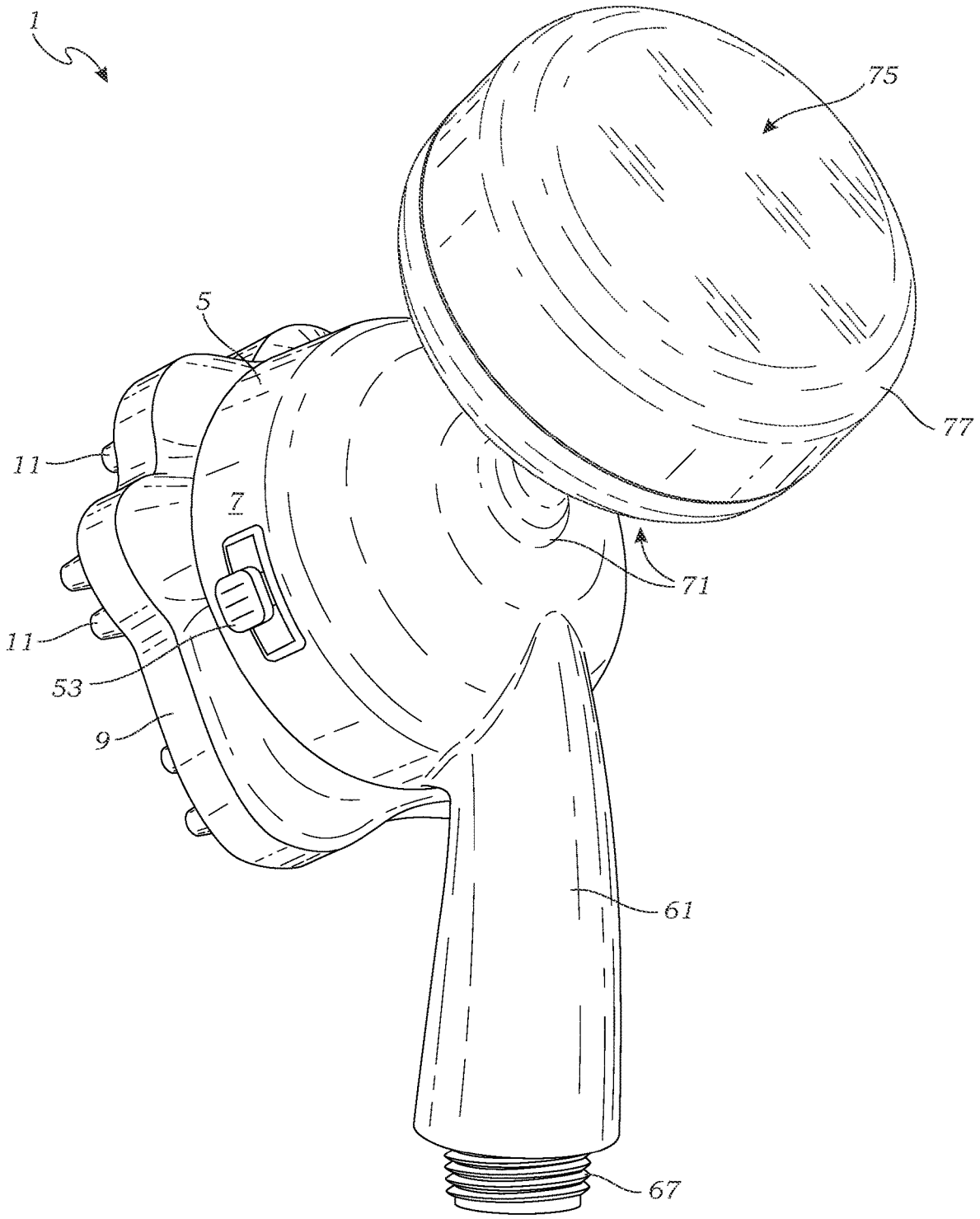
FIG. 2 is a rear perspective view of the showerhead assembly.

The present invention addresses the aforementioned disadvantages by providing an improved showerhead assembly. While the showerhead assembly is susceptible of embodiment in various forms, as shown in the drawings, hereinafter will be described the presently preferred embodiments of the invention with the understanding that the present disclosure is to be considered as an exemplification of the invention, and it is not intended to limit the invention to the specific embodiments illustrated.

With reference to FIGS. 1-10, the showerhead assembly 1 includes a showerhead 5 having a traditional appearance including a housing 7 and a face 9. The face 9 includes nozzles 11 of any type as can be selected for providing a shower experience. The showerhead 5 may be constructed to connect directly to a threaded pipe typically found in a shower stall. However, as illustrated in the Figures, the preferred showerhead 5 is of the handheld type and thus the showerhead assembly includes a hollow handle 61. The handle 61 extends longitudinally to create a longitudinal axis. Preferably, the showerhead's face 9 is positioned to be at an angle, such as 45° to 90° relative to the handle's longitudinal axis. Furthermore, the handle 61 includes a central channel 65 for transporting water to the showerhead 5. The handle's proximal end includes male threads 67 for connecting to a flexible hose (not shown). Meanwhile, the showerhead 5 is affixed to the distal end of the handle 61.

Figure 5:
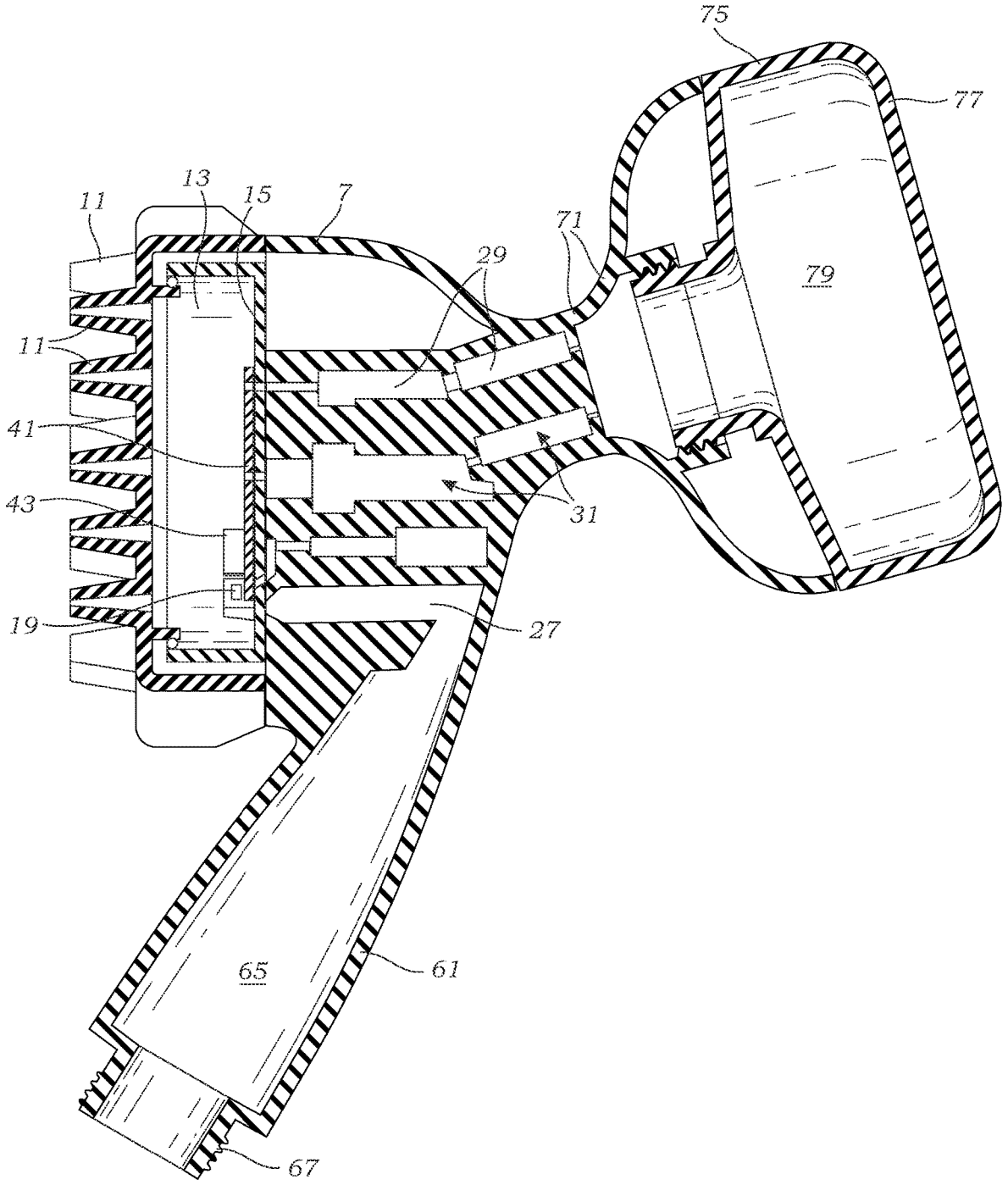
FIG. 5 is a side cut-away view of the showerhead assembly.

As best illustrated in FIG. 5, the handle's channel 65 supplies water to the showerhead 5. As further illustrated in FIG. 6, the showerhead 5 includes a primary water conduit 27 which transports water from the handle's channel 65 to a cavity 13 formed within the showerhead 5. As best illustrated in FIG. 5, water from a water source travels up the handle's channel 65 before being diverted into the primary water conduit 27. The showerhead's primary conduit 27 then supplies water to the cavity 13 which is formed between a cavity wall 15 and the showerhead's face 9. As best illustrated in FIGS. 5-8, the cavity wall 15 has a primary outlet hole 17 connected to the primary conduit 27 to allow water to travel from the primary conduit 27 into the cavity 13. Preferably, the showerhead assembly 1 includes an inlet diverter 19 which causes the water entering into the cavity 13 to be directed orthogonally throughout the cavity 13 instead of directly to the showerhead's nozzles 11. Water pressure in the cavity 13 causes water to be expelled uniformly through the showerhead's nozzles 11.

Figure 3:
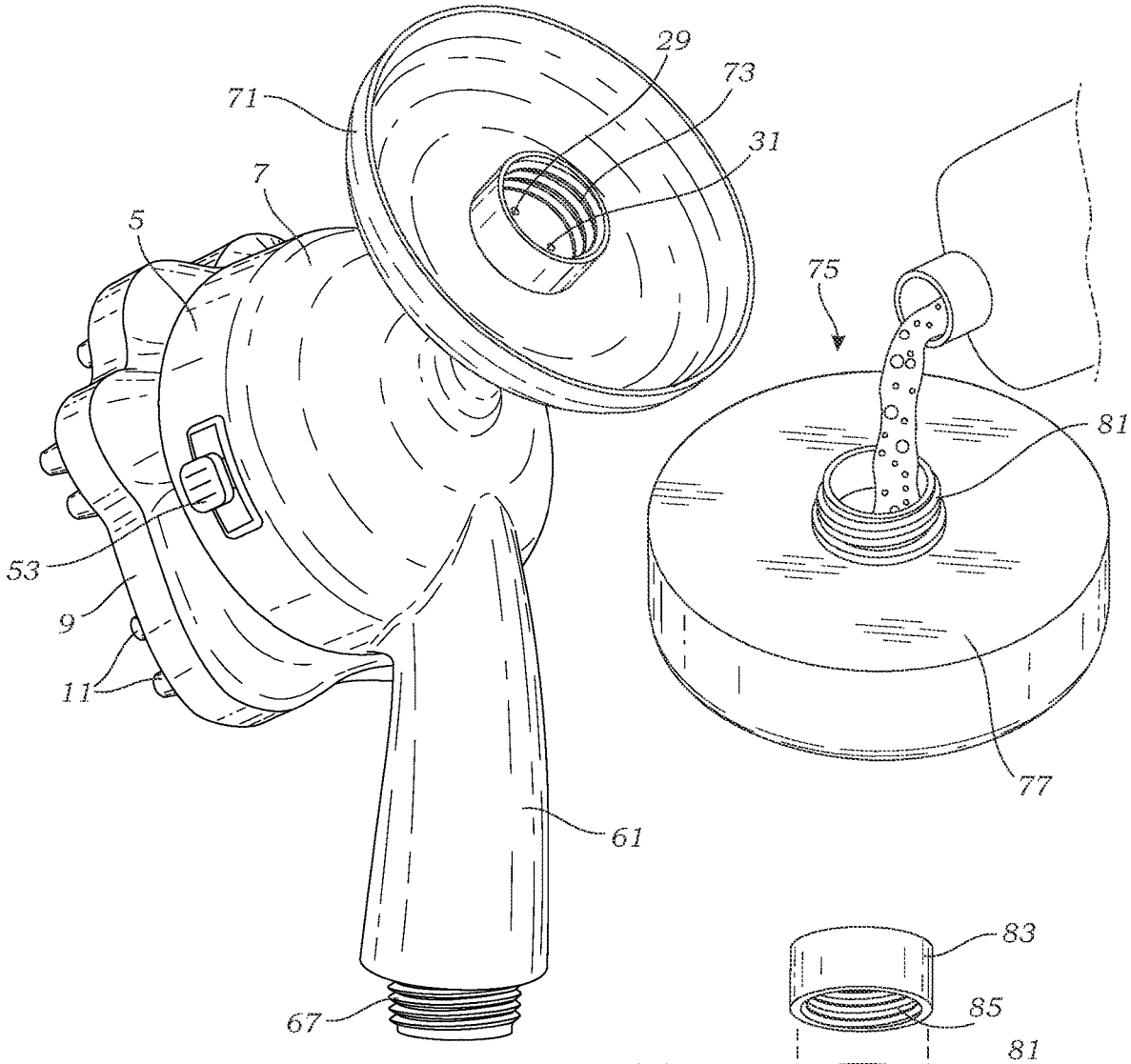
FIG. 3 is a rear perspective view of the showerhead assembly with its reservoir removed.
Figure 4:
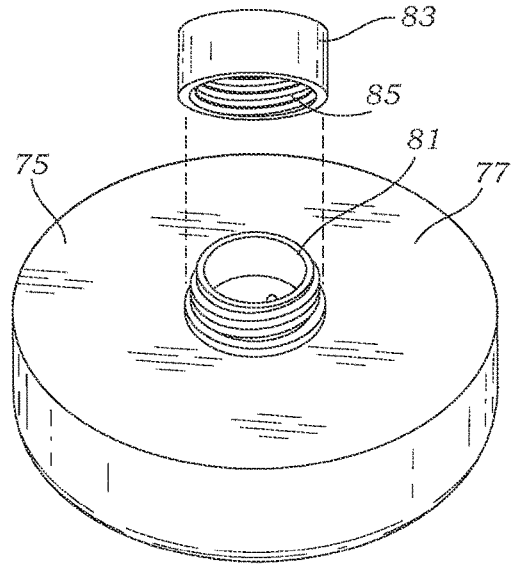
FIG. 4 is a rear perspective view of the showerhead assembly's reservoir removed for sealing with a cap.

The showerhead assembly 1 further includes a reservoir 75 for storing soap or shampoo. The reservoir 75 includes a housing 77 which forms a central chamber 79 in which the soap or shampoo is located. The reservoir 75 is connected to the showerhead 5 by a transition section 71. Preferably, the reservoir 75 is connectable and disconnectable to the transition section by providing the reservoir 75 with male threads 81 which threadably connect to female threads 73 formed on the exterior of the transition section 71. As illustrated in FIGS. 3 and 4, preferably the reservoir 75 can be detached from the rest of the showerhead assembly 1 for the introduction of shampoo or soap into the reservoir's chamber 79. In a preferred embodiment, the showerhead assembly 1 may include a cap 83 so that the shampoo or soap may be stored separately from the showerhead 5. Advantageously, soap or shampoo may be prepackaged and sold separately in a capped container 75 wherein the container's male threads 81 are constructed for connecting to the showerhead assembly's transition section 71.

The showerhead assembly's reservoir 75 is connected to the showerhead assembly's cavity 13 by an inlet conduit 29 and an outlet conduit 31. Any water in the cavity 13 is capable of passing through an inlet hole 21 formed in the cavity wall 15 into the inlet conduit 29 so as to enter the reservoir's chamber 79. Water entering the reservoir 75 is capable of mixing with any fluid previously located within the reservoir, such as soap or shampoo. Thereafter, the mixture of water and soap or shampoo is then capable of re-entering the cavity 13 by traveling through outlet conduit 31 through an outlet hole 23 formed in the cavity wall 15.

Preferably, the showerhead assembly includes a controller assembly 39 for selectively allowing water to pass through the transition section 71 into and out from the reservoir 75 so as to selectively allow shampoo or soap to enter to the showerhead assembly's cavity 13, and in turn to be sprayed from the nozzles 11. The controller may comprise various switching apparatus as can be determined by those skilled in the art. However, as illustrated in the Figures, the preferred controller assembly includes an obstructer plate 41 which can be selectively rotated to cover the cavity wall's inlet diverter 19, inlet hole 21 and outlet hole 23.

As best illustrated in FIGS. 6-10, the preferred obstructer plate 41 includes a plate inlet hole 45, a plate outlet hole 47, and a tab 43. The plate 41 is rotatably attached to the cavity wall 15 by a pin 49 which passes into a circular hole 25 formed in the cavity wall. The plate 41 is capable of rotating about an axis defined by the pin 49 so as to enable one to selectively align the plate inlet hole 45 with the cavity wall inlet hole 21, and selectively align the plate outlet hole 47 with the cavity wall outlet hole 23. Once these holes are properly aligned, water from within the cavity 13 is capable of travelling through these holes. Furthermore, when the holes are aligned, water travels through the inlet conduit 29 so as to allow a mixture of water and shampoo or soap to form in the reservoir. The mixture of water and shampoo or soap then passes through outlet conduit 31 back into the cavity 13 so as to be dispensed from nozzles 11.

When shampoo or soap is not intended to be sprayed from the nozzles 11, the obstructer plate 41 is rotated so that plate inlet hole 45 does not align with the cavity wall inlet hole 21, and the plate outlet hole 47 does not align with the cavity wall outlet hole 23. Similarly, the plate's tab 43 can be made to align and block the flow of water from the inlet diverter 19. Preferably, the tab 43 only predominantly, but does not totally, block the supply of water through the inlet diverter 19 so that at least a trickle of water continues to be expelled from the nozzles 11 so as to maintain constant water temperature that is being expelled from the nozzles 11.

Figure 6:
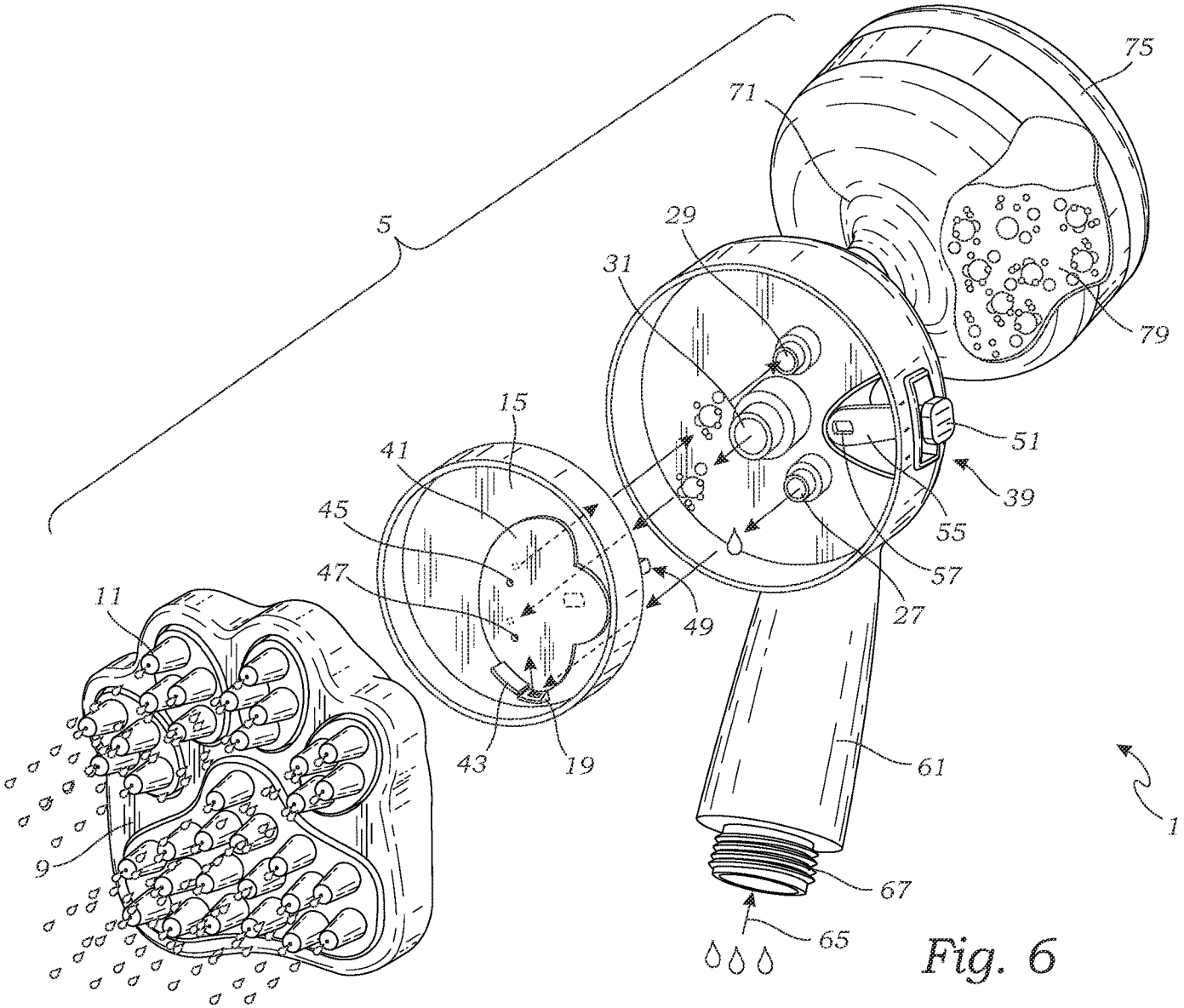
FIG. 6 is an exploded front perspective view of the showerhead assembly illustrating the application of shampoo function being disabled.
Figure 7:
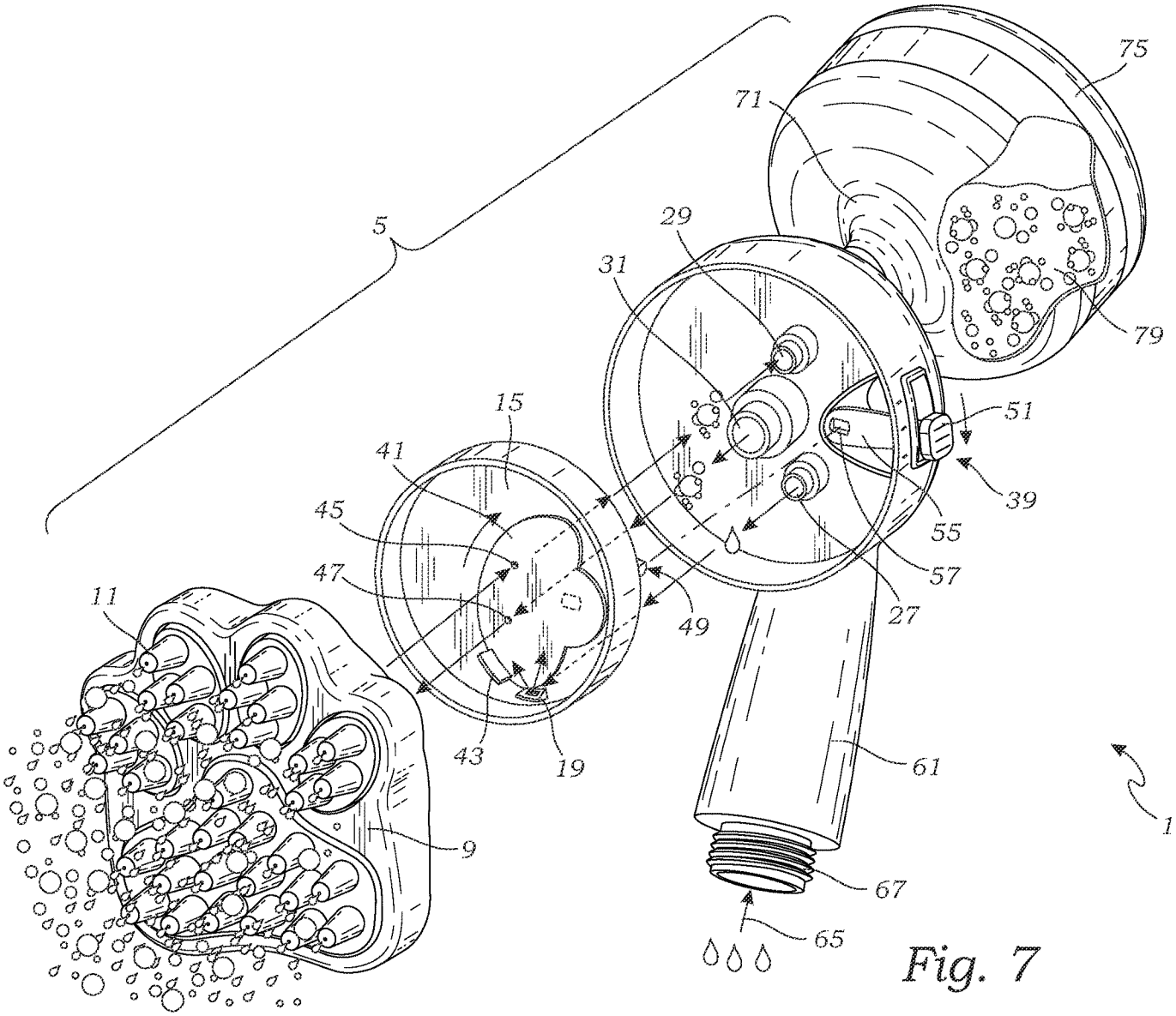
FIG. 7 is an exploded front perspective view of the showerhead assembly illustrating the application of shampoo function being enabled.
Figure 8:
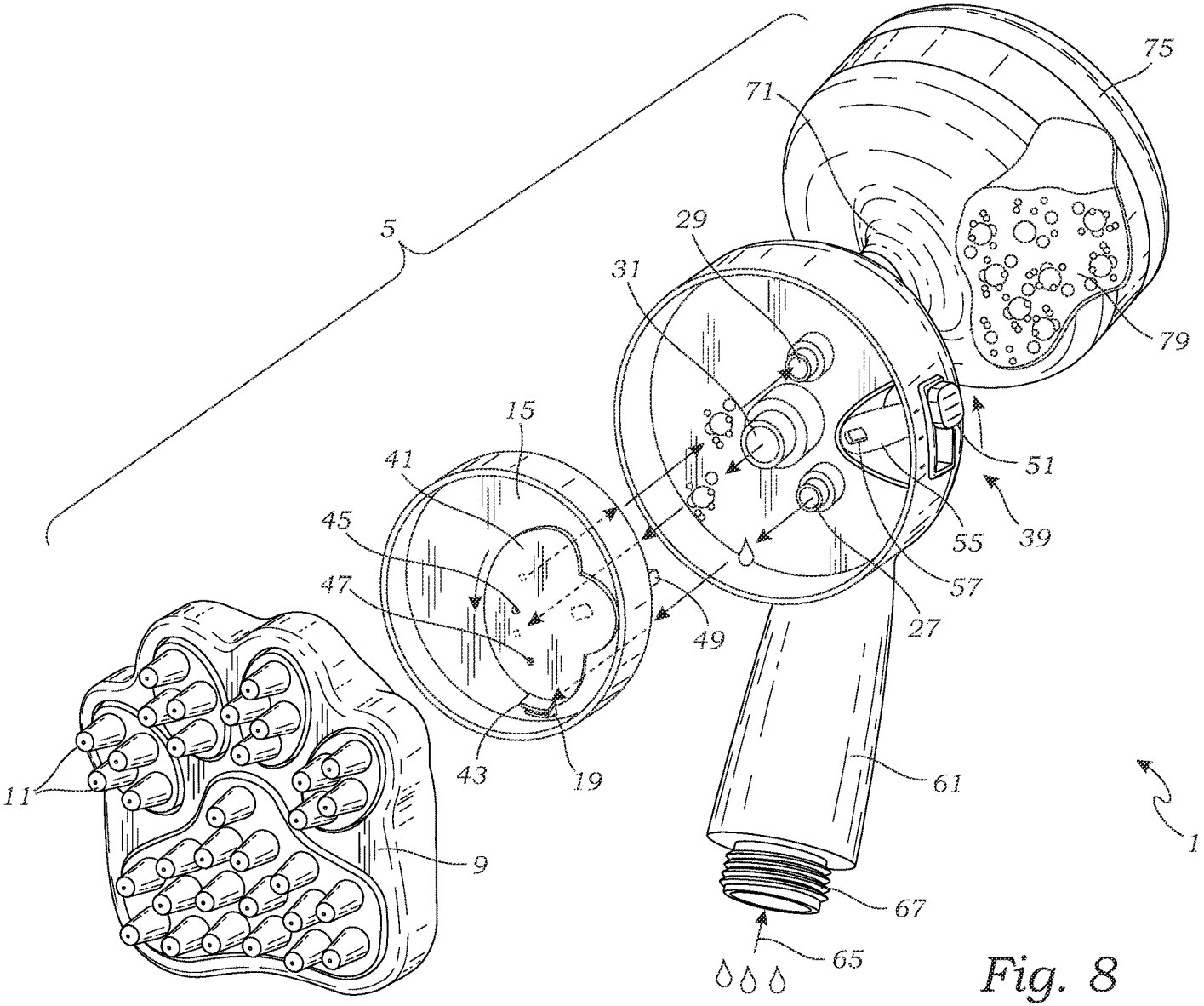
FIG. 8 is an exploded front perspective view of the showerhead assembly illustrating the application of shampoo function and primary fluid flow being disabled.
Figure 9:
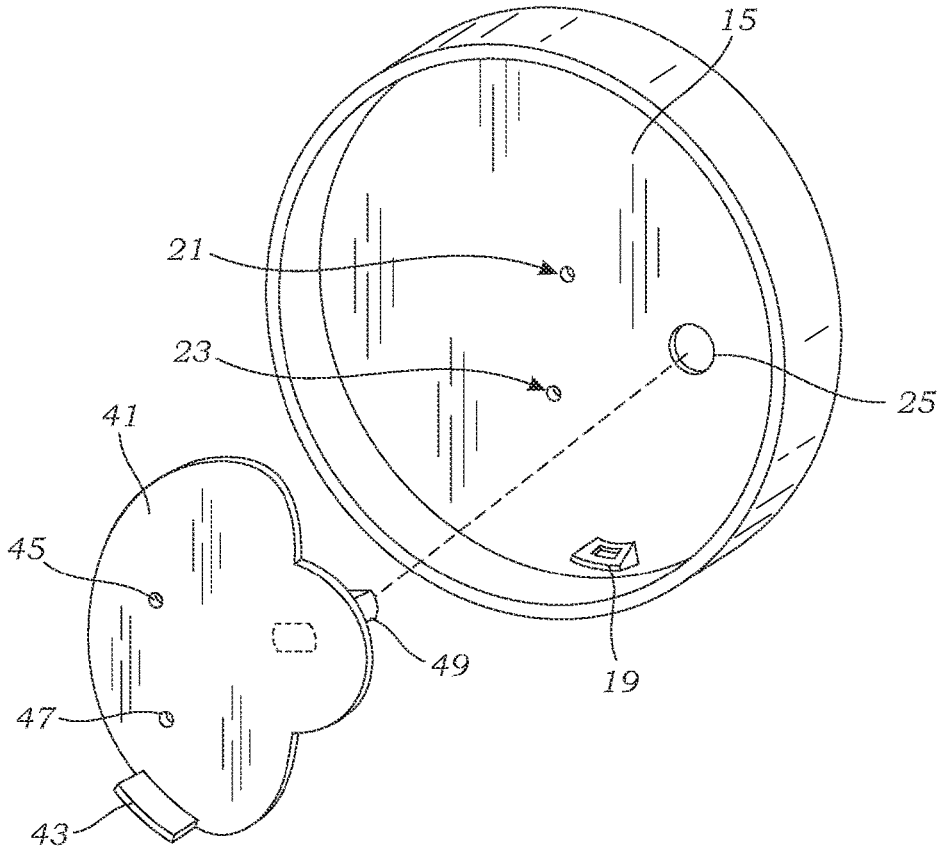
FIG. 9 is an exploded front perspective view of the showerhead assembly's preferred controller including cavity wall and obstructer plate.
Figure 10:
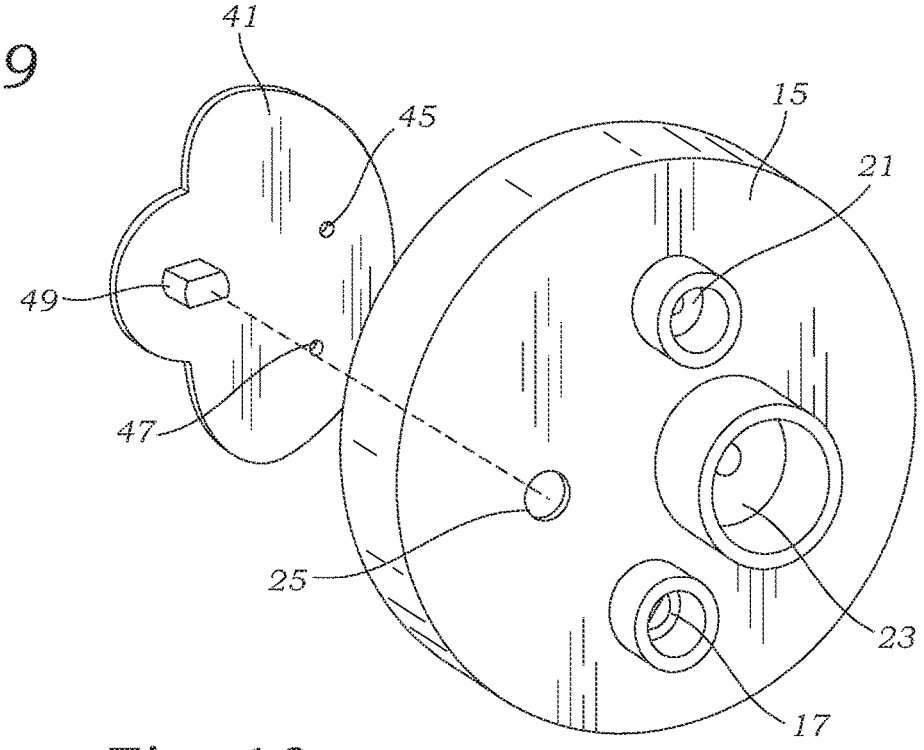
FIG. 10 is an exploded rear perspective view of the showerhead assembly's preferred controller including cavity wall and obstructer plate.

Rotation of the controller assembly's plate 41 is controlled by a switch 51 having a slidable button 53 and a lever arm 55. Preferably, the switch's arm 55 has a hole which is keyed to accept the plate's pin 49. As illustrated in FIGS. 6-8, the controller assembly 39 preferably provides three settings. As illustrated in FIG. 6, when the button 53 is positioned in a first setting, the plate's inlet hole 45 and outlet hole 47 are not aligned with the cavity wall's inlet hole 21 and outlet hole 23 so that water is prevented from flowing through the inlet conduit 29 and outlet conduit 31. However, the plate's tab 43 does not block the inlet diverter 19 so that water is capable of entering the cavity 13 from the hollow handle 61, and the water is then expelled through nozzles 11. However, any soap or shampoo within the reservoir 75 is not capable of being introduced into the flow of water expelled from the nozzles.

In a second setting illustrated in FIG. 7, the switch's button 53 is depressed downwardly so as to rotate the plate 41 so as to properly align the plate's inlet hole 45 and outlet hole 47 with the cavity wall's inlet hole 21 and outlet hole 23. In this setting, the plate's tab 43 continues to not block the flow of water through the inlet diverter 19. Water is capable of entering the cavity 13 from the hollow handle, and water is further capable of passing through the inlet conduit 29 into the reservoir 75. Water mixes with the soap or shampoo within the reservoir before then travelling through the outlet conduit 31 to once again enter into the cavity 13. The mixture of water and shampoo or soap entering the cavity 13 then mixes with additional water still being introduced through the inlet diverter 19 before being sprayed through the showerhead's nozzles 11.

In still a third setting illustrated in FIG. 8, the switch's button 53 is pushed upwardly so as to rotate the plate 41 so as to block the cavity wall's inlet hole 21, and outlet hole 23. Furthermore, the plate's tab 43 is rotated to obstruct the inlet diverter 19. The inlet conduit 29 and outlet conduit 31 are completely blocked so that any shampoo within the reservoir 75 is incapable of entering into the cavity 13. In addition, the inlet diverter 19 is partially blocked by the tab 43, but a trickle of water is capable of entering into the cavity 13 which is then expelled through nozzles 11.

Advantageously, the showerhead assembly 1 of the present invention includes an integrated reservoir 75 for storing soap or shampoo. Furthermore, the reservoir is disengagable from the showerhead 5 so as to be easily filled or replaced with a prepackaged shampoo or soap container or the like.

While a preferred showerhead assembly has been illustrated and described, it would be apparent that various modifications can be made without departing from the spirit and scope of the invention. Still alternative embodiments may be envisioned by those skilled in the art after consideration of the present disclosure. For example, a showerhead assembly of the present invention may include two or more reservoirs instead of just a single reservoir. Such a multi-reservoir showerhead assembly would include an additional inlet conduit and an additional outlet conduit which extend through the transition section to connect each additional reservoir to the showerhead's cavity. In addition, the controller assembly would be modified, such as by including additional holes in the obstructer plate, to selectively allow or obstruct fluids from flowing from the additional reservoirs through the additional conduits to the cavity. Thus, the present showerhead assembly is not intended to be limited to the single reservoir construction which is primarily described and illustrated herein.

Accordingly, it will be apparent that various modifications can be made without departing from the spirit and scope of the invention. Therefore, having described my invention in such terms such as to enable a person skilled in the art to understand the invention, recreate the invention and practice it, and having presently identified the presently preferred embodiment thereof,

I claim:

1. The showerhead assembly comprising:

an elongate hollow handle having a male threaded proximal end, a distal end, a central channel which extends the length of said handle, and a primary water conduit which receives water from said central channel;

a showerhead affixed to the distal end of said elongate hollow handle, said showerhead having a housing, a face, one or more nozzles which extend from said face, and a cavity wall within said housing which forms a cavity between said face and said cavity wall, said cavity wall includes a water supply hole in fluid communication with said primary water conduit, an inlet hole, and an outlet hole;

a transition section including an inlet conduit connected to said cavity wall's inlet hole and outlet conduit connected to said cavity wall's outlet hole, said transition section including a threaded end; and a reservoir including a central chamber wherein soap or shampoo can be stored, said reservoir further including a threaded opening threadably connected to said transition section's threaded end; and wherein water is capable of flowing through said central channel to fill said showerhead cavity before being expelled through said nozzles or flowing through said cavity wall inlet hole and said transition section inlet conduit into said reservoir and then flowing through said transition section outlet conduit and said cavity wall outlet hole into said showerhead cavity and then being expelled through said nozzles.

2. The showerhead assembly of claim 1 further comprising:

a controller assembly having a switch and an obstructer plate;

said obstructor plate including a plate inlet hole, a plate outlet hole, and a tab, said obstructor plate rotationally affixed to said cavity wall so as to provide said obstructor plate with a rotational axis about which said obstructor plate rotates;

said obstructor plate capable of rotating to a first position wherein said obstructor plate blocks both said cavity wall's inlet hole and said cavity wall's outlet hole, and wherein said tab at least partially blocks said water supply hole;

said obstructor plate capable of rotating to a second position wherein said plate inlet hole aligns and does not cover said cavity wall's inlet hole, and wherein said obstructor plate's outlet hole aligns and does not cover said cavity wall's outlet hole, and wherein said tab does not block said water supply hole; and said switch controlling said obstructor plate's rotation and thereby controlling the alignment of said plate inlet hole relative to said cavity wall's inlet hole, the alignment of said plate outlet hole relative to said cavity wall's inlet hole, and the alignment of said tab relative to said water supply hole.

3. The showerhead assembly of claim 1 wherein said water supply hole includes an inlet diverter which expels water throughout said cavity orthogonally relative to said nozzles.

4. The showerhead assembly of claim 2 wherein said water supply hole includes an inlet diverter which expels water throughout said cavity orthogonally relative to said nozzles.

5. The showerhead assembly of claim 2 wherein said controller assembly's switch includes a slidable button and a lever arm, and said lever arm extends from said obstructor plate to said button.

6. The showerhead assembly of claim 5 wherein said button is manually slidable into a first position, a second position, and a third position.

7. The showerhead assembly of claim 5 wherein when said button is in said first position, said obstructor plate is rotated to a position wherein said cavity wall's inlet hole is blocked by said obstructor plate thereby preventing water from flowing from said cavity into said central chamber, and said cavity wall's outlet hole is blocked by said obstructor plate thereby preventing fluid flow from said central chamber into said cavity, and said water supply hole is obstructed by said tab so as to prevent water flow from said handle into said cavity to expel through said nozzles.

8. The showerhead assembly of claim 5 wherein when said button is in said second position, said obstructor plate is rotated so that said obstructor plate's inlet hole is properly aligned with said cavity wall's inlet hole thereby allowing water to flow from said cavity to said central chamber, said obstructor plate's outlet hole is properly aligned with said cavity wall's outlet hole so as to transport fluid from said central chamber to said cavity, and said inlet water supply hole is unobstructed by said tab so as to allow water flow from said handle into said cavity.

9. The showerhead assembly of claim 5 wherein said button is in a third position, said obstructor plate is rotated so that said cavity wall's inlet hole is blocked by said obstructor plate thereby preventing water from flowing from said cavity to said central chamber, said cavity wall's outlet hole is blocked by said obstructor plate thereby preventing fluid flow from said central chamber to said cavity, but said water supply hole is not blocked by said tab thereby allowing water to be expelled through said nozzles.

10. The showerhead assembly of claim 1 wherein said reservoir includes male threads which can be sealed with a female threaded cap so as to be covered and stored separate from said showerhead.

* * * * *